US006405722B2

(12) United States Patent
Colby

(10) Patent No.: US 6,405,722 B2
(45) Date of Patent: Jun. 18, 2002

(54) SINGLE STAGE REGULATOR AND METHOD FOR REGULATING COMPRESSED AIR THEREFOR

(76) Inventor: Daniel H. Colby, 509 Landmeier Rd., Elk Grove Village, IL (US) 60007

( * ) Notice: Subject to any disclaimer, the term of this patent is extended or adjusted under 35 U.S.C. 154(b) by 0 days.

(21) Appl. No.: 09/803,380

(22) Filed: Mar. 9, 2001

Related U.S. Application Data

(60) Provisional application No. 60/188,825, filed on Mar. 9, 2000.

(51) Int. Cl.[7] ..... F41B 11/00

(52) U.S. Cl. ..... 124/74; 124/70; 124/71; 124/72; 124/73; 124/75; 124/69; 137/505.11; 137/505.14; 137/505.16; 137/505.29; 137/503.37; 137/509; 137/510

(58) Field of Search ..... 124/69, 70, 71, 124/72, 73, 74, 75; 137/505, 509, 510

(56) References Cited

U.S. PATENT DOCUMENTS

| | | | | | |
|---|---|---|---|---|---|
| 2,123,324 | A | * | 7/1938 | Webby | 124/73 |
| 3,420,220 | A | * | 1/1969 | Ferrando | 124/70 |
| 3,542,008 | A | * | 11/1970 | Vadas | 124/38 |
| 4,116,193 | A | * | 9/1978 | Chiba | 124/51.1 |
| 4,616,622 | A | * | 10/1986 | Milliman | 124/71 |
| 4,819,609 | A | * | 4/1989 | Tippmann | 124/48 |
| 4,936,282 | A | * | 6/1990 | Dobbins et al. | 124/73 |
| 5,265,582 | A | * | 11/1993 | Bhogal | 124/73 |
| 5,280,778 | A | * | 1/1994 | Kotsiopoulos | 124/31 |
| 5,383,442 | A | * | 1/1995 | Tippmann | 124/73 |
| 5,613,483 | A | * | 3/1997 | Lukas et al. | 124/70 |
| 5,704,342 | A | * | 1/1998 | Gibson et al. | 124/73 |
| 5,755,213 | A | * | 5/1998 | Gardner et al. | 124/73 |
| 5,769,066 | A | * | 6/1998 | Schneider | 124/75 |
| 6,024,077 | A | * | 2/2000 | Kotsiopoulos | 124/71 |
| 6,065,460 | A | * | 5/2000 | Lotuaco, III | 124/72 |
| 6,276,354 | B1 | * | 8/2001 | Dillon | 124/31 |

* cited by examiner

*Primary Examiner*—Charles T. Jordan
*Assistant Examiner*—Stephen A Holzen
(74) *Attorney, Agent, or Firm*—Baniak Pine & Gannon

(57) ABSTRACT

A single stage regulator is disclosed wherein a piston-type configuration is utilized to regulate an input working pressure as high as 4,500 PSI, to an output delivery pressure from 200 PSI to 1100 PSI. The single stage regulator can be used on paintball guns, markers and similar devices powered by compressed gas.

1 Claim, 3 Drawing Sheets

SINGLE STAGE REGULATOR AND METHOD FOR REGULATING COMPRESSED AIR THEREFOR

This application claims benefit of Prov. No. 60/188,825 filed Mar. 9, 2000.

TECHNICAL FIELD OF THE INVENTION

The present invention relates to a single stage regulator apparatus and method for regulating output delivery pressure, and more particularly the present invention relates to a single stage piston-type regulator configured to be attached to a paintball gun or a (commonly referred to) marker and a method for receiving input working pressure of up to 4,500 pounds per square inch (PSI), and regulating the output delivery pressure from approximately 50 PSI to about 1200 PSI. The single stage regulator of the present invention has the ability to be adjusted by the user to increase or decrease the output delivery pressure.

BACKGROUND OF THE INVENTION

In recent years, as the popularity of paintball games has grown, there has been a proliferation of different types of paintball guns, air guns or markers, and the devices that are used in conjunction with these markers. These new markers and related devices have become necessary due to the increased level of play as users of these markers improve and hone their skills.

The early types of markers and related devices provided an adequate level of play. However, the onset of more experienced players, along with challenging paintball gun tournaments, now provides an arena where better markers and peripherals are required to sufficiently compete.

As such, there is a great need for devices that speed up a player's level of play while still providing the necessary accuracy needed during play. Further, there is a need for a device that allows a player certain capabilities before, during, and after competitions and tournaments. Some of these capabilities include the ability to adjust the output pressure level, and the ability to easily remove pressure vessels under full pressure.

Also, a need exists for a device that allows the removal of a pressure vessel, under full pressure, so that the vessel can be recharged or filled, and returned to the marker. To transport the Marker and operating components in a compact and disassembled mode. More importantly, there is a need for a player to be able to place a different vessel onto the marker while in full play conditions under severe time constraints. This capability addresses the need that arises during different games, such as speedball, wooded, heavy terrain, etc.

Further, because players may be right-handed or left-handed there is a need for a regulator that can be adapted or converted for a right or left hand player. In other words, there is a need for a regulator that allows the regulated pressure output hose to be placed on either side of the pistol grip. A regulator's mounting system must also have the ability to provide ease of bi-directional attachment for the regulator system, so that the regulator system can be adjusted to the player's arm length and playing style.

There is a need for such a high-precision regulator that incorporates these inadequacies found in many of the current regulators.

SUMMARY OF THE INVENTION

Accordingly, the main object of the present invention is to provide a single stage regulator, that addresses the above listed disadvantages and others.

The single stage regulator of the present invention is a high quality, stainless steel and anodized aluminum, cost affordable, single stage regulator designed to accept inlet pressures ranging as high as 4,500 pounds PSI, can be factory pre-set to a particular output pressure, i.e., 700 PSI, and can be post adjusted by the user. The regulator has been carefully machined from high tensile strength stainless steel and aluminum alloy. The present invention has been equipped with industry standard ⅝×18 thread to securely semi permanently insert/mount the valve body threaded tang into the pressure vessel.

The present invention relates to a single stage regulator having a piston-type configuration that accepts an input working pressure of up to 4,500 PSI and is designed to regulate the output delivery pressure from about 50 PSI to 1,200 PSI. The single stage regulator is designed such that the user of the regulator can determine the output delivery pressures.

It is another aspect of the present invention that the single stage regulator includes a valve body assembly and a main body assembly. The valve body is preferably stainless steel and comprises a valve pin and spring, a seat seal, a seat seal retainer and a hollow hex Allen seat seal retainer set screw. The main body assembly is made of aluminum alloy and comprises the main body, the main spring, the piston, the piston seal carrier, and the outlet pressure adjustment strut. Both the main body assembly and the valve body assembly contain various O-rings.

It is yet another aspect of the present invention to provide a single stage regulator wherein the high-pressure bottle (along with the valve body assembly) can be removed from the main body assembly without first emptying the bottle of its gas contents. Further, the single stage regulator of the present invention is designed such that the high-pressure bottle can be removed while full maximum pressure, without the need for an on/off valve as found in other types of regulators.

It is yet another aspect of the present invention to provide a single stage regulator that is designed and configured to allow the refilling of the high-pressure bottle through the valve body assembly of the regulator, whether the high-pressure bottle and valve assembly is attached to the main body assembly or not.

It is yet another aspect of the present invention to provide a single stage regulator that can be installed on particular paintball guns or markers that already contain a single stage regulator. Once the single stage regulator of the present invention is installed on these particular markers, the present invention works with the existing regulator to generate a dual-stage regulator.

It is yet another aspect of the present invention to provide a single stage regulator comprising a mounting rail designed and configured to be attached to the pistol grip of a marker, such that the main body assembly of the single stage regulator can be attached to the mounting rail. The mounting rail is designed such that it can be attached to the pistol grip in two different directions, forward or rear facing. The valve body assembly can then be attached to the main body assembly.

It is yet another aspect of the present invention to provide a single stage regulator comprising two output ports, one on either side of the main body assembly of the regulator, such that an output hose can be attached to the marker at one end, and to either of the output ports, depending on the preference of the user.

It is yet another aspect of the present invention to provide a single stage regulator comprising a piston with a pressure relief mode, which provides an additional safety measure if the high-pressure compressed gas exerts too great an incoming regulated pressure.

DETAILED DESCRIPTION OF THE PREFERRED EMBODIMENTS

The present invention is a piston-type, single stage regulator, designed to accept input working pressures up to 4500 PSI, and designed to regulate an output pressure range of between 50 and 1200 PSI, similar to the Air America Armageddon single stage regulator. The present invention is compatible with virtually all of the paintball guns or markers currently used in the sport of Paintball. The preferred embodiment of the present invention incorporates high and low side pressure safety methods, ambidextrous input/output hose and gauge positioning, fractional on-grip slide mounting rail adjustment and precision input and output gauges.

Figure 1:
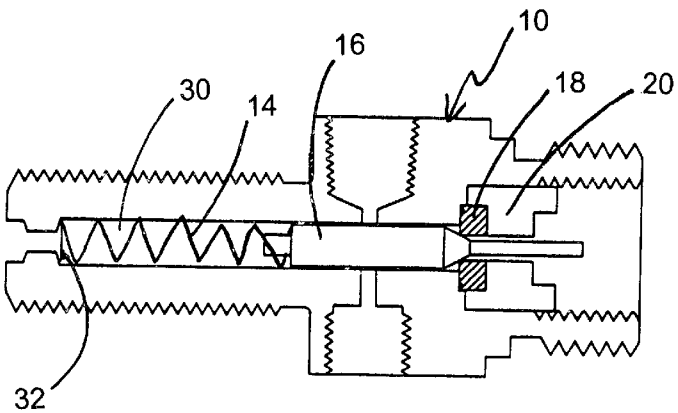
FIG. 1 is an exploded sectional view of a valve body assembly for use in a single stage regulator for markers in accordance with the present invention.

FIG. 1 shows a sectional view of the valve body assembly or arm assembly 10 in accordance with the present invention. As will be described in detail herein, the valve body assembly 10 locates between the main body assembly and the high-pressure bottle. The valve body assembly 10 also provides an outlet for connecting a pressure status gauge to monitor the output pressure levels.

The valve body assembly 10 is precision machined and made from stainless steel, although other high strength materials can be used in the manufacture of the device.

In the present invention, the valve body assembly 10 is connected to a high-pressure bottle, and is not supposed to be removed from the bottle. When all of the air or nitrogen is expelled from the bottle, the bottle can be refilled through a port on the valve body assembly, as discussed below.

Figure 2:
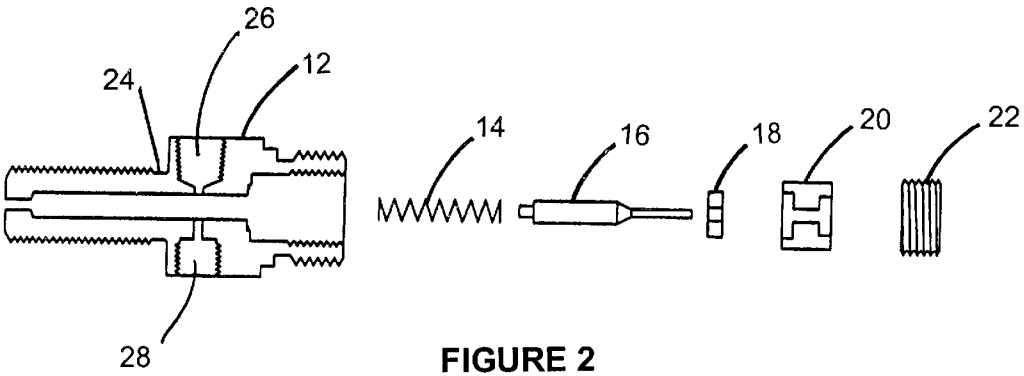
FIG. 2 is a sectional view of a valve body assembly for use in a single stage regulator for markers in accordance with the present invention.

FIG. 2 shows an exploded view of the valve body assembly 10 or arm assembly in accordance with the present invention. The valve body assembly includes the valve body 12, the arm spring 14, the valve pin 16, the seat seal 18, the seat seal retainer 20, and the seat seal retainer set screw 22. The seat seal is a polymer material, preferably DuPont's KEL-F81. Not shown are the valve O-rings and the safety burst disk.

The valve body assembly 10 is configured to seat the valve O-rings (two locations). The valve O-ring indents 24 are located in two places circumferentially on the valve body 12 thereby allowing the O-rings to be secured in place and to prevent gas from escaping from the high-pressure bottle. Although the preferred embodiment provides for two O-rings on the valve body 12, in certain instances, one O-ring might suffice.

The safety burst disk (not shown) is positioned in the safety burst disk port 26. If the pressure in the valve body becomes too great, the safety burst disk will release from the safety burst disk port 26. When the safety burst disk releases, gas escapes through the port 26, reducing the pressure in the valve body assembly. In accordance with current Compressed Gas Association (CGA) safety standard recommendations, the burst disk should release at 1.5 times the input pressure rating. For a system in which the input pressure rating is 4,500 PSI, thus the burst disk should release if the input pressure reaches about 6,750 PSI.

The valve body assembly also contains a high-pressure inlet male fitting (not shown) used for filling the high-pressure bottles, such as the Air America standard Q/Fill fitting. The male fitting attaches to the valve body 12 at the inlet male filling port 28. The present invention can be used with a fill station containing a suitably rated female fitting. When the high-pressure bottle is empty, the filing station containing the female fitting is connected to the valve body assembly at the high-pressure inlet male fitting, and high pressure gas, air or nitrogen is transferred from the filling station through the valve body assembly and into the high-pressure bottle.

FIG. 1 shows the valve body assembly parts interconnected with each other in accordance with the present invention. The valve spring 14 is placed into a spring cavity 30 inside the valve body 12. The valve pin 16 is also placed inside the spring cavity 30, such that the back end of the valve pin 16 makes contact with the valve spring 14. The valve spring 14 acts to keep the valve pin 16 from making contact with the back-side 32 of the spring cavity 30. The seat seal 18 and seat seal retainer 20, are configured and positioned inside the valve body 12, such that the spring 14 forces the pin 16 towards the seat seal 18. The pin 16 will rest at the seat seal 18. The hollow hex allen seat seal retainer set screw 22 is screwed into the valve body 12 to set the seat seal retainer 20 and the seat seal 18 in place.

Figure 3:
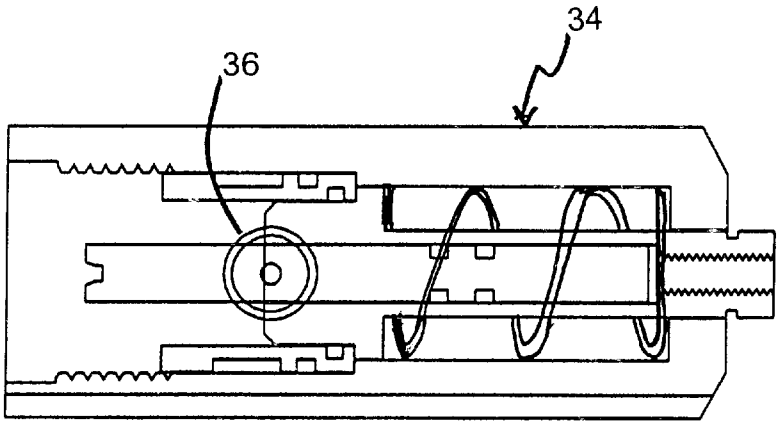
FIG. 3 is an exploded sectional view of a front body assembly for use in a single stage regulator for markers in accordance with the present invention.

FIG. 3 shows a sectional view of the front or main body assembly 34 in accordance with the present invention. As will be described in detail herein, the main body assembly 34 attaches to the pistol grip of the marker and is configured to accept the valve body assembly 10. The main body assembly 34 also provides an outlet 36 for connecting a braided steel hose or microline to the marker itself. This connection allows the regulated output pressure gas to be sent to the marker where it is used to expel the paintball from the marker.

The main body assembly 34 is made from stainless steel and high strength, tempered alloy aluminum, although other high strength materials can be used in the manufacture of the device.

Figure 4:
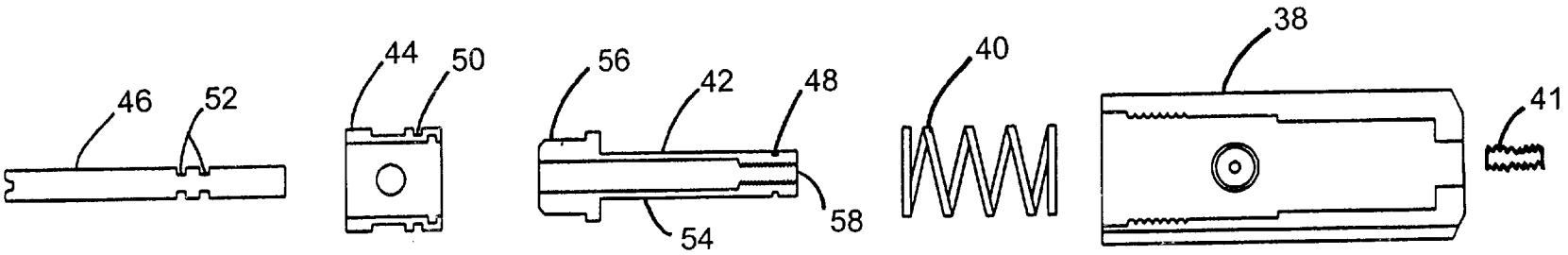
FIG. 4 is a sectional view of a front body assembly for use in a single stage regulator for markers in accordance with the present invention.

FIG. 4 shows an exploded view of the main body assembly 34 in accordance with the present invention. The main body assembly 34 includes the main body 38, main spring 40, the piston 42, the piston seal carrier 44, and the outlet pressure adjustment strut 46. Not shown are the various main body split rings and O-rings, which are located circumferentially on the various parts of the main body assembly 34. The piston 42 has a split ring located at the split ring indent 48. The piston seal carrier 44 has an O-ring located at the piston seal indent 50. The outlet pressure adjustment strut 46, has two O-rings located at the adjustment strut indents 52.

The main body assembly 34 is constructed by inserting the main spring 40 into the main body 38. Next, the piston 42 is located into the main body 38, such that the body 54 of the piston 42 floats inside the main spring 40. The head 56 of the piston 42 makes contact with the main spring 40, such that the main spring 40 forces the piston 42 toward the piston seal carrier 44. The outlet pressure adjustment strut 46 is placed all of the way inside the piston 42. An outlet pressure adjustment set screw 41 is screwed into the base 58 of the main piston 42. The outlet pressure adjustment set screw 41 is used to adjust the outlet pressure depending on the location of the screw. When the screw 41 is turned clockwise, the regulated output pressure increase, and when the screw 41 is turned counterclockwise, the regulated output pressure decreases.

Figure 5:
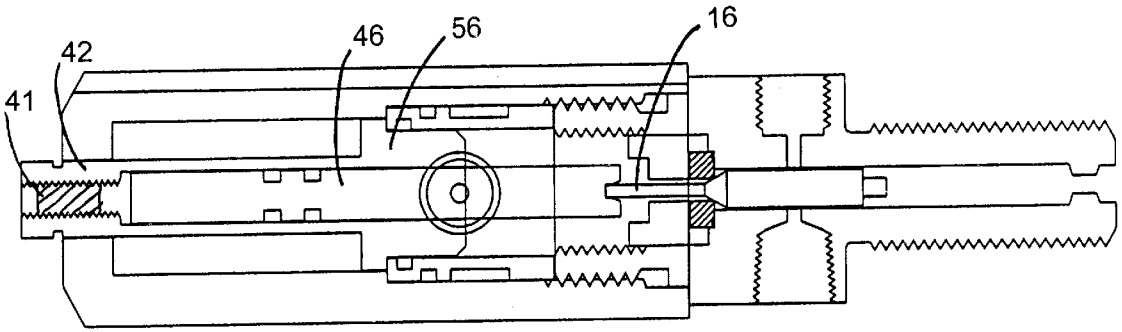
FIG. 5 is a sectional view of a front body assembly and valve body assembly constructed for use in a single stage regulator for markers in accordance with the present invention.

FIG. 5 shows the valve body assembly 10 of FIG. 1 screwed into or connected to the main body assembly 34 of FIG. 3. For clarity purposes, the O-rings, split ring and main 40 and valve 14 springs are not shown. Upon connecting the main body assembly 34 with the valve body assembly 10, the piston 16 makes contact with the outlet pressure adjustment strut 46, which has been adjusted, as described above, by turning the regulated pressure adjustment set screw 41, either clockwise, to increase the regulated output pressure, or counterclockwise to decrease the regulated output pressure.

To set the output pressure of the regulator, the outlet pressure adjustment set screw 41 is rotated inside the main piston 42, to the point that it abuts the outlet pressure adjustment strut 46, thereby forcing the strut 46 towards the head 56 of the piston 42. In doing so, the range of motion of the strut 46 is somewhat limited, depending on the adjustment distance of the adjustment set screw 41. Once the set screw 41 is properly positioned, and the range of motion of the strut 46 is set, then the range of the pin 16, which abuts the strut 46, will also be limited, when the valve body assembly 10 is attached to the main body assembly 34.

Figure 6:
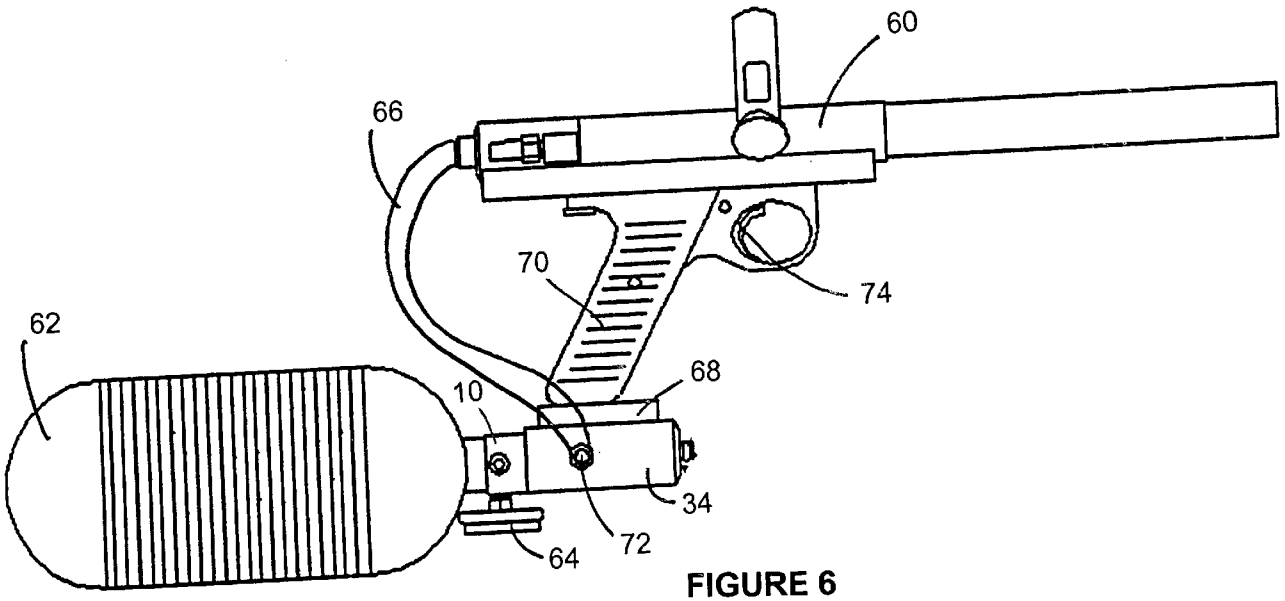
FIG. 6 is a side view of a front body and valve body assembly constructed and fastened to a marker, a high pressure bottle and a high pressure status gauge in accordance with the present invention.

FIG. 6 shows the marker 60, the high-pressure bottle or vessel 62, the pressure status gauge 64, the output hose 66, and the mounting rail 68, connected and ready to be used. To get to this point, however, the regulator must be mounted to the marker 60 by attaching the mounting rail 68 to the pistol grip 70 of your marker 60. In the preferred embodiment, the rail 68 is configured to use two 10-32 Allen screws with a center-to-center spacing of ¾" (not shown). This is the standard thread and spacing found on many popular marker models, such as the AutoMag and the Autococker. There are of course, other ways to mount such a rail 68.

When the mounting rail 68 has been secured, the regulator can be attached to the rail 68 by sliding the regulator onto the dovetail portion (not shown) of the rail 68. The rail 68 can be installed with the long end facing either forward or to the rear, allowing for an additional lateral adjustment range of the regulator. The regulator can be positioned with respect to the user's arm length and shooting style. A light to medium torque on the rail set-screw (not shown) will secure the regulator in the selected position.

Once the regulator is mounted on the marker 60, the output hose 70 can be attached from the regulated output port male quick disconnect fitting 72 on the main body assembly 34 of the regulator, to the marker 60.

As discussed above, the valve body assembly 10 is connected to the pressure vessel 62, and should not be removed. The pressure status gauge 64 can be connected to the valve body assembly 10, thereby providing the user with an output pressure reading. The filled vessel 64 and valve body assembly 10 are next connected to the main body assembly 34, which has been attached to the pistol grip 70 of the marker 60. The system is now ready to be used.

As stated previously, the vessel 62 can be filled when it is attached to the system or remotely. Further, the regulator allows for the easy removal of the pressure vessel 62, whether or not the vessel 62 is empty, without the need for a separate on/off valve. Vessels 62 can be removed from and reinserted into the main body assembly 34 under full pressure, "by hand" without the use of any clamping or holding device other than a moderate grip.

Referring back to figures FIGS. 1 through 5, the operation of the single stage regulator of the present invention can be understood. Once the set screw 41 is rotatively positioned for the proper output pressure, and the system is connected as described and shown in FIG. 6 (the set screw 41 can be accessed for adjustment even after the main body 34 and valve body 10 are connected), the system is ready to be fired, expelling the ammunition (paint balls) from the marker at the target. Today's markers can provide high-speed semi-automatic and automatic firing, in excess of 17 paint balls per second (and even higher rates).

When the valve body assembly 10 is connected to the main body assembly 34, initially, the main spring 40 forces the piston 42 and the strut 46 towards the valve pin 16. The strut 46 makes contact with the pin 16 and unseats the valve pin 16 from the seat seal 18. Once the valve pin 16 is unseated, a pre-determined amount of propellant can escape from the vessel attached to the valve body assembly 10, through the opening left by the unseated valve pin 16, and into the main body assembly 34. The pre-determined amount of propellant, and the related regulated pressure, will be dependent on the distance that the pin 16 is unseated, which in turn is dependent on how far the adjustment set screw 41 has "pushed" the adjustment strut 46 towards the valve pin 16. The system is now ready to fire.

When the user pulls the trigger 74 on the marker 60, a demand is created for the propellant gas. The propellant travels from the main body assembly 34 through the regulated pressure supply hose 66 into the marker 60, and forces or expels the paint ball (not shown) from the marker 60.

Once the propellant exits the main body assembly 34, the pressure therein is reduced. This reduction in pressure allows the main spring 40 to force the piston 42 back towards the piston seal carrier 44. When the piston 42 moves in this direction, the adjustment strut 46 also moves therewith. As the strut 46 moves in that direction, it again makes contact with the valve pin 16, which in turn unseats the valve pin 16 from the seat seal 18, thereby allowing the main body assembly to again fill with a pre-determined amount of propellant.

It can be seen that this process can occur at high speeds and, depending on the marker 60, the regulator can provide propellant to the marker 60 that will allow the marker 60 to expel many paint balls per second.

As described above, the system can be charged or filled, on or off the marker 60, i.e., independent of the main body assembly 34 that is secured to the pistol grip of your marker. There are many systems used for filling the vessel 62, one example, is the Air America 4500 PSI pressure rated Stainless Steel male quick disconnect Q/Fill quick fill assembly. The quick fill system is connected to the male quick disconnect fitting closest to the bottle on the Stainless Steel valve body assembly 10, opposite the high pressure status gauge 64.

The Air America 4500 PSI pressure rated Stainless Steel male quick disconnect Q/fill is a standard Q/fill fitting that can be used with the present invention, and has a suitably rated female fitting that is compatible with the Air America Q/Fill male adapter.

As described above, the regulated output delivery pressure is adjusted with the small 10/32 adjusting set screw 41, located in the threaded piston 42. Using a suitable Allen key for the adjustment, turn the set screw 41 in, clockwise, thereby increasing the regulated output pressure. Turning the set screw 41 out, counter-clockwise, reduces the regulated output pressure.

If the user's playing style requires that the regulated pressure output port be switched to the opposite side of the main body assembly 34, the change can be made by swapping the low pressure gauge (gauge face: 1200 PSI), and the male regulated output pressure fitting, from side to side.

The piston 42 has a 0.060 pressure relief hole approximately ½ inch from the set screw 41 access point. This configuration prevents any back pressure on the adjustment strut.

The foregoing detailed description of the invention is intended to be illustrative and not intended to limit the scope of the invention. Changes and modifications are possible with respect to the foregoing description, and it is understood that the invention may be practiced otherwise than that specifically described herein and still be within the scope of the claims.

What is claimed is:

1. A single stage regulator for use on a marker, comprising:

A) a main body assembly, said main body assembly comprising a main body, a main spring, a piston a piston seal carrier, an outlet pressure adjustment strut, and an outlet pressure adjustment set screw, said main body assembly is configured such that said main spring is inserted into said main body, said piston is inserted into said main spring, said piston seal carrier is located over said piston, said outlet pressure adjustment strut being located inside and extending out of said piston, said outlet pressure adjustment set screw, located at the end of the main body, such that said outlet pressure adjustment set screw is capable of being rotated to adjust said outlet pressure adjustment strut; and B) a valve body assembly comprising a valve body, a valve spring, a valve pin, a seat seal, a seat seal retainer, and a seat seal retainer set screw, said valve assembly is configured such that said valve spring is inserted into said valve body, said valve pin is inserted into said valve body, making contact with said valve pin, said seat seal is inserted into said valve body thereby prohibiting said valve pin from completely exiting said valve body, said seat seal retainer is inserted into said valve body such that said seat seal retainer makes contact with and contains said seat seal, and said seat seal retainer set screw is rotatively inserted into said valve body, containing said seat seal retainer, wherein said main body assembly is configured to be connected to said valve body assembly, such that when said main body assembly and said valve body assembly are connected, said outlet pressure adjustment strut makes contact with said valve pin.

* * * * *